US009755300B2

(12) United States Patent
Kagaya et al.

(10) Patent No.: US 9,755,300 B2
(45) Date of Patent: Sep. 5, 2017

(54) WINDSHIELD AND ANTENNA

(71) Applicant: ASAHI GLASS COMPANY, LIMITED, Tokyo (JP)

(72) Inventors: Osamu Kagaya, Tokyo (JP); Koji Ikawa, Tokyo (JP)

(73) Assignee: ASAHI GLASS COMPANY, LIMITED, Tokyo (JP)

( * ) Notice: Subject to any disclaimer, the term of this patent is extended or adjusted under 35 U.S.C. 154(b) by 186 days.

(21) Appl. No.: 14/853,227

(22) Filed: Sep. 14, 2015

(65) Prior Publication Data

US 2016/0006112 A1 Jan. 7, 2016

Related U.S. Application Data

(63) Continuation of application No. PCT/JP2014/058902, filed on Mar. 27, 2014.

(30) Foreign Application Priority Data

Mar. 27, 2013 (JP) ..... 2013-067197

(51) Int. Cl.
*H01Q 1/32* (2006.01)
*H01Q 1/12* (2006.01)
(Continued)

(52) U.S. Cl.
CPC ..... *H01Q 1/325* (2013.01); *H01Q 1/1278* (2013.01); *H01Q 1/1285* (2013.01); *H01Q 9/16* (2013.01);
(Continued)

(58) Field of Classification Search
CPC ..... H01Q 1/325; H01Q 1/1285; H01Q 9/16; H01Q 13/10; H01Q 1/1278; H01Q 13/16; H01Q 5/385; H01Q 13/106
See application file for complete search history.

(56) References Cited

U.S. PATENT DOCUMENTS 5,012,255 A 4/1991 Becker
2012/0098715 A1* 4/2012 Dai ..... H01Q 1/1278 343/712
(Continued)

FOREIGN PATENT DOCUMENTS

EP 2 453 521 A1 5/2012
JP 2001-185928 A 7/2001
(Continued)

*Primary Examiner* — Dieu H Duong
(74) *Attorney, Agent, or Firm* — Foley & Lardner LLP

(57) ABSTRACT

A windshield includes a glass plate; a dielectric; an electrothermal layer that is disposed between the glass plate and the dielectric, and includes a conductive layer and strip electrodes having a resistance lower than a resistance of the conductive layer; and an antenna including a pair of electrodes disposed to face the electrothermal layer across the dielectric, and a slot at least a part of which is formed in one of the strip electrodes such that the slot is disposed between the pair of electrodes in plan view. The strip electrodes are disposed along at least two opposing outer edges of the conductive layer and are DC-coupled to the conductive layer such that the conductive layer is energized via the strip electrodes. One end of the slot is an open end that is open at an outer edge of the electrothermal layer.

14 Claims, 12 Drawing Sheets

(51) Int. Cl.

| | |
|---|---|
| ***H01Q 9/16*** | (2006.01) |
| ***H01Q 13/10*** | (2006.01) |
| ***H01Q 13/16*** | (2006.01) |
| *H01Q 5/385* | (2015.01) |

(52) U.S. Cl.
CPC ..... *H01Q 13/10* (2013.01); *H01Q 13/106* (2013.01); *H01Q 13/16* (2013.01); *H01Q 5/385* (2015.01)

(56) References Cited

U.S. PATENT DOCUMENTS

| | | | | |
|---|---|---|---|---|
| 2012/0154229 | A1 | 6/2012 | Kagaya et al. | |
| 2012/0256798 | A1* | 10/2012 | Paulus ..... | H01Q 13/10 343/713 |
| 2013/0257664 | A1 | 10/2013 | Kagaya et al. | |
| 2015/0222006 | A1* | 8/2015 | Dai ..... | H01Q 13/10 343/712 |

FOREIGN PATENT DOCUMENTS

| | | | |
|---|---|---|---|
| WO | WO 2011/004877 | A1 | 1/2011 |
| WO | WO 2012/073790 | A1 | 6/2012 |

* cited by examiner

WINDSHIELD AND ANTENNA

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2014/058902, filed on Mar. 27, 2014, which is based on and claims the benefit of priority of Japanese Patent Application No. 2013-067197 filed on Mar. 27, 2013, the entire contents of which are incorporated herein by reference.

BACKGROUND OF THE INVENTION

1. Field of the Invention

A certain aspect of this disclosure relates to an antenna including a slot and a windshield including the antenna.

2. Description of the Related Art

There exists a known windshield including a conductive layer in which a slot is formed so that the conductive layer functions as an antenna (see, for example, WO 2011/004877). The antenna disclosed in WO 2011/004877 includes a pair of electrodes that face the conductive layer across a glass plate. The antenna is configured such that the slot formed in the conductive layer is disposed between the electrodes when the electrodes are projected onto the conductive layer, and the electrodes and the conductive layer are capacitively coupled. The configuration of WO 2011/004877 where a conductive layer is formed on a windshield makes it possible to receive a desired radio wave even when there is no space for installing a linear conductor antenna of the related art.

However, a high antenna gain is required for an antenna provided on a windshield so that the antenna can function in various environments. Even in the case of an antenna using a conductive film as disclosed in WO 2011/004877, it is desired to further improve the antenna gain.

SUMMARY OF THE INVENTION

In an aspect of this disclosure, there is provided a windshield including a glass plate; a dielectric; an electrothermal layer that is disposed between the glass plate and the dielectric, and includes a conductive layer and strip electrodes having a resistance lower than a resistance of the conductive layer; and an antenna including a pair of electrodes disposed to face the electrothermal layer across the dielectric, and a slot at least a part of which is formed in one of the strip electrodes such that the slot is disposed between the pair of electrodes in plan view. The strip electrodes are disposed along at least two opposing outer edges of the conductive layer and are DC-coupled to the conductive layer such that the conductive layer is energized via the strip electrodes. One end of the slot is an open end that is open at an outer edge of the electrothermal layer.

DESCRIPTION OF THE PREFERRED EMBODIMENTS

Figure 1:
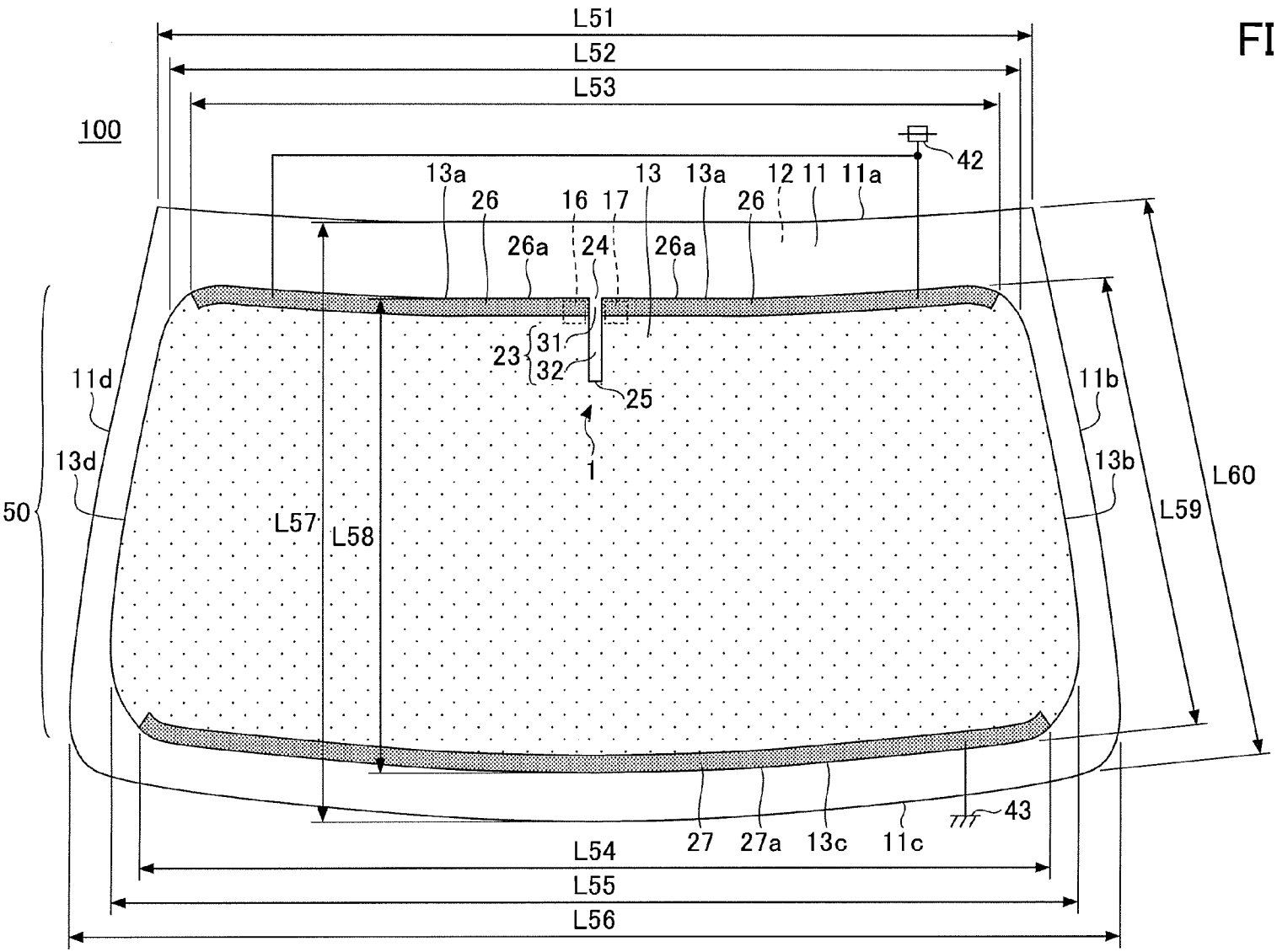
FIG. 1 is a plan view of a windshield.

A description will hereinafter be given of embodiments of the present invention with reference to the drawings. In the drawings used to describe the embodiments, directions refer to the directions in the figures unless otherwise indicated, and reference directions in the figures correspond to the directions indicated by symbols or reference numerals. In addition, directions that are parallel, perpendicular, or the like may tolerate an error to a certain extent that does not impair the effects of the present invention. Also, examples of windshields to which the present invention can be applied include a front windshield attached to the front of a vehicle, a rear windshield attached to the rear of a vehicle, a side windshield attached to a side of a vehicle, and roof glass attached to the roof of a vehicle.

FIG. 1 is a plan view of a windshield 100 according to an embodiment of the present invention. The windshield 100 includes a first glass plate 11, a second glass plate 12 used as a dielectric, and an electrothermal layer 50 provided between the first glass plate 11 and the second glass plate 12. The electrothermal layer 50 includes a conductive layer 13, and bus bars 26 and 27 that are a pair of strip electrodes disposed along at least two opposing outer edges of the conductive layer 13 and DC-coupled to the conductive layer 13. The windshield 100 also includes an antenna 1. The antenna 1 includes a pair of electrodes 16 and 17 disposed to face the electrothermal layer 50 (at least one of the conductive layer 13 and the bus bars 26 and 27) across the second glass plate 12, and a slot 23 that is disposed between the electrodes 16 and 17 in plan view and at least a part of which is formed in the bus bar 26. Here, FIG. 1 illustrates a state where the electrothermal layer 50 is seen through the first glass plate 11.

The first glass plate 11 is a transparent or translucent plate-shaped dielectric. The windshield 100 is laminated glass formed by bonding the first glass plate 11 and the second glass plate 12 via an interlayer. However, the windshield 100 is not limited to laminated glass formed by bonding multiple glass plates. For example, the windshield 100 may be composed of one glass plate, a dielectric, and an electrothermal layer provided between the glass plate and the dielectric.

The conductive layer 13 is a transparent or translucent layer having conductivity. The electrothermal layer 50 is configured such that the conductive layer 13 can be energized via the bus bars 26 and 27. The conductive layer 13 is a conductor that when, for example, a voltage is applied between the pair of bus bars 26 and 27 and an electric current is supplied to the conductive layer 13, heats the windshield 100 to, for example, melt snow, melt ice, or prevent fogging on the windshield 100.

The conductive layer 13 may be stacked on a surface of the first glass plate 11 facing the inside of a vehicle. When the windshield 100 is laminated glass, the conductive layer 13 may be disposed between the first glass plate 11 and the second glass plate 12 constituting the laminated glass, or may be disposed between one of the glass plates 11 and 12 and an interlayer.

The conductive layer 13 may be formed by coating a surface of a glass plate with a conductive material (e.g., silver) by, for example, a deposition or sputtering method. Also, the conductive layer 13 may be formed by coating a surface of a resin film (e.g., polyethylene terephthalate) provided separately from a glass plate using a deposition method. As the conductive material, for example, a zinc oxide layer (e.g., a gallium-doped zinc oxide (GZO) layer), indium tin oxide (ITO), gold, or copper may also be used.

Layer edges 13*a* through 13*d* outlining the conductive layer 13 are located at positions that are set back from glass edges 11*a* through 11*d* outlining the first glass plate 11 by a predetermined distance in an in-plane direction of the first glass plate 11. Also, the conductive layer 13 may be disposed such that the layer edges 13*a* through 13*d* are located at the same positions as the glass edges 11*a* through 11*d* instead of being set back from the glass edges 11*a* through 11*d*. The layer edges 13*a* through 13*d* may also be the outer edges of the electrothermal layer 50.

The conductive layer 13 may have a shape similar to the shape of the windshield. The windshield generally has a trapezoidal shape, and the conductive layer 13 also has a trapezoidal shape. However, the windshield and the conductive layer 13 may have any other polygonal shape such as a triangular shape or a quadrangular shape. Also, corners of the conductive layer 13 may have an arc shape.

The bus bars 26 and 27 are a pair of strip electrodes that are disposed along two opposing outer edges of the conductive layer 13 and DC-coupled to the conductive layer 13. The bus bars 26 and 27 are electrodes that are made of a material having a resistance lower than the resistance of the conductive layer 13 and disposed at the corresponding ends of the conductive layer 13. In the example of FIG. 1, the bus bar 26 is disposed to extend along the layer edge 13*a* that is to be placed on the roof side when the windshield 100 is attached to a vehicle, and the bus bar 27 is disposed to extend along the layer edge 13*c* that is to be placed on the chassis side when the windshield 100 is attached to a vehicle.

Also in the example of FIG. 1, the bus bars 26 and 27 are disposed to overlap the conductive layer 13 in plan view of the windshield 100. However, the bus bars 26 and 27 do not necessarily overlap the conductive layer 13 as long as they are DC-coupled to the conductive layer 13. Also in the example of FIG. 1, outer bus bar edges 26*a* and 27*a* of the bus bars 26 and 27 closer to the glass edges are located at the same positions as the layer edges 13*a* and 13*c*. However, the outer edges of the bus bars 26 and 27 may be located at positions different from the positions of the outer edges of the conductive layer 13. For example, the bus bar 26 may be disposed such that an edge of the bus bar 26 facing the inner region of the windshield (i.e., an inner edge of the bus bar 26) is located at the same position as the layer edge 13*a*.

The bus bars 26 and 27 may be stacked on a surface of the first glass plate 11 facing the inside of a vehicle. When the windshield 100 is laminated glass, the bus bars 26 and 27 may be disposed between the first glass plate 11 and the second glass plate 12 constituting the laminated glass, or may be disposed between one of the glass plates 11 and 12 and an interlayer. The bus bars 26 and 27 may be disposed in the same layer as the conductive layer 13, or may be disposed in a different layer from the conductive layer 13 as long as the bus bars 26 and 27 can be DC-coupled to the conductive layer 13 via an auxiliary part.

For example, to apply a voltage between the bus bars 26 and 27 in order to supply an electric current to the conductive layer 13, when the windshield 100 is attached to a vehicle, the bus bar 26 is DC-coupled to a power source 42 and the bus bar 27 is DC-coupled to a ground 43. The power supply 42 is, for example, a cathode of a direct-current power supply such as a battery, and the ground 43 is, for example, an anode of a direct-current power supply such as a battery or a vehicle frame (body grounding). Alternatively, the power source 42 may be connected to the bus bar 27, and the ground 43 may be connected to the bus bar 26.

Any configuration may be used to electrically connect the bus bars 26 and 27 to the power source 42 and the ground 43. For example, when the bus bars 26 and 27 are disposed inside of the laminated glass, the bus bars 26 and 27 may be electrically connected to the power source 42 and the ground 43 via electrode lead lines that are made of, for example, copper foil and extend from an outer edge of the laminated glass. Also, the power source 42 and the ground 43 may be electrically connected to the bus bars 26 and 27 that are exposed by removing a part of one of glass plates forming the laminated glass.

The bus bars 26 and 27 (particularly the bus bar 26 in which at least a part of the slot 23 is formed) are electrodes for the electrothermal layer 50 and have a sheet resistance (which is also referred to as "surface resistivity" and expressed in Q) lower than that of the conductive layer 13. For the bus bars 26 and 27, for example, metal foil or a thin layer made of, for example, copper or silver having a sheet resistance lower than that of the conductive layer 13 may be used.

The antenna 1 includes the electrodes 16 and 17 and the slot 23, and is powered via the electrodes 16 and 17. The antenna 1 is a bipolar antenna using the two electrodes 16 and 17 as feeders.

The electrodes 16 and 17 are feeders disposed to face the electrothermal layer 50 (at least one of the conductive layer 13 and the bus bar 26) across the second glass plate 12 that is a dielectric. In the example of FIG. 1, because the first glass plate 11 and the second glass plate 12 overlap each other, the electrodes 16 and 17 are disposed on a surface of the second glass plate 12 (in an upper side in FIG. 1) and face both of the conductive layer 13 and the bus bar 26 across the second glass plate 12. Because the second glass plate 12 used as a dielectric is provided between the electrodes 16 and 17 and the conductive layer 50, the electrodes 16 and 17 are capacitively coupled via the second glass plate 12 to the electrothermal layer 50.

At least a part of the slot 23 is formed in the bus bar 26 such that the slot 23 is located between the electrodes 16 and 17 in plan view of the windshield 100. In the example of FIG. 1, the slot 23 is formed in both of the bus bar 26 and the conductive layer 13. Here, "a slot is located between a pair of electrodes" may also indicate a configuration where one of the electrodes is disposed to overlap the slot in plan view of the windshield. In this case, a part of the one of the electrodes overlapping the slot also overlaps a part of the bus bar 26 that is located on the opposite side of the slot from another one of the electrodes.

The slot 23 includes a bus bar slot (strip electrode slot) 31 at least a part of which is formed in the bus bar 26. The bus bar slot 31 is a narrow area where the bus bar 26 is removed or not formed. The slot 23 also includes a conductive layer slot 32 at least a part of which is formed in the conductive layer 13. The conductive layer slot 32 is a narrow area where the conductive layer 13 is removed or not formed. In the example of FIG. 1, the bus bar slot 31 and the conductive layer slot 32 extend linearly in an in-plane direction of the conductive layer 13 and communicate with each other.

The bus bar slot 31 may be formed by cutting the bus bar 26 with a cutter when the bus bar 26 is comprised of metal foil, or may be formed by removing the bus bar 26 by irradiating the bus bar 26 with a laser beam when the bus bar 26 is formed by coating. Also, the bus bar slot 31 may be formed by, for example, masking an area corresponding to the bus bar slot 31 during a coating or printing process of the bus bar 26 and thereby not forming the bus bar 26 in the area. Similarly, the conductive layer slot 32 may be formed by irradiating the conductive layer 13 with a laser beam and thereby removing a part of the conductive layer 13, or by, for example, masking an area corresponding to the conductive layer slot 32 during a process of forming the bus bar 26 and thereby not forming the bus bar 26 in the area. Other slots described later may also be formed in a similar manner.

One end of the slot 23 is an open end 24 that is open at an outer edge of the electrothermal layer 50. In the example of FIG. 1, because the bus bar 26 overlaps the conductive layer 13 and the position of the bus bar edge 26*a* matches the position of the layer edge 13*a*, the open end 24 is open at both of the layer edge 13*a* and the bus bar edge 26*a*. Also in the example of FIG. 1, another end 25 of the slot 23 that is opposite from the open end 24 is closed in the conductive layer 13.

With the above configuration, an electric current generated along the slot 23 flows into the conductive layer 13 and the bus bar 26, and electricity is supplied to the electrodes 16 and 17 that can be capacitively coupled to the electrothermal layer 50 (at least one of the conductive layer 13 and the bus bar 26). Thus, the above configuration functions as an antenna. As described above, at least a part of the slot 23 is formed in the bus bar 26 with a resistance lower than that of the conductive layer 13. This configuration facilitates generation of an electric current along the slot 23. Compared with a configuration where a slot is formed only in the conductive layer 13, this configuration makes it possible to improve the antenna gain.

In the example of FIG. 1, the antenna 1 is disposed in the middle of a roof-side opening edge of a vehicle in the lateral direction. This positioning of the antenna 1 is preferable to improve the antenna gain. However, the position of the antenna of the present invention is not limited to the middle position in the lateral direction, and may be shifted to a pillar side.

FIGS. 2 through 6 illustrate various layered structures of the windshield of the present embodiment. In FIGS. 2 through 6, the electrothermal layer 50 is disposed between the glass plate 11 and a dielectric (the glass plate 12 or a dielectric substrate 33). A part or the whole of the electrodes 16 and 17 overlaps the electrothermal layer 50 when seen from the stacking direction. Although the bus bar 26 does not overlap the conductive layer 13 in FIGS. 2 through 6, the bus bar 26 and the conductive layer 13 may be overlapped and connected with each other.

Figure 2:
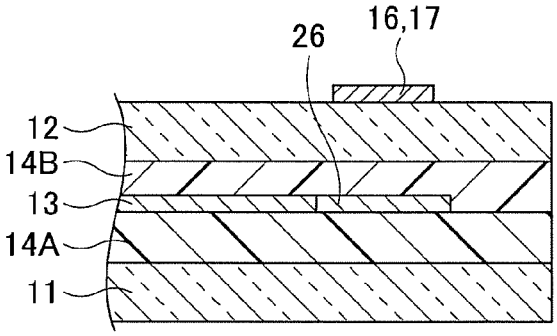
FIG. 2 is a cut-away side view of a windshield.
Figure 3:
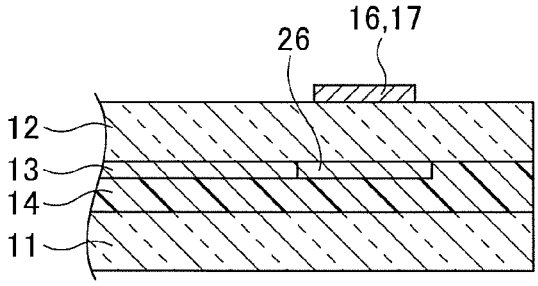
FIG. 3 is a cut-away side view of a windshield.
Figure 4:
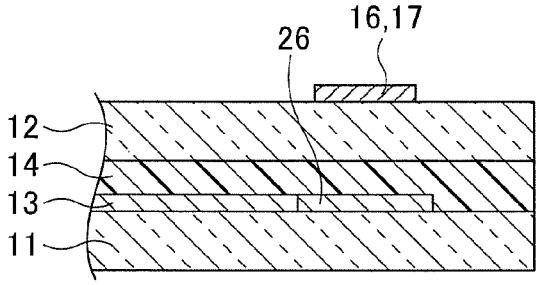
FIG. 4 is a cut-away side view of a windshield.

In FIGS. 2 through 6, the electrothermal layer 50 and an interlayer 14 (or interlayers 14A and 14B) are disposed between the glass plate 11 and the glass plate 12. In the example of FIG. 2, the film-like conductive layer 13 is disposed between the interlayer 14A contacting a surface of the glass plate 11 facing the glass plate 12 and the interlayer 14B contacting a surface of the glass plate 12 facing the glass plate 11. The film-like conductive layer 13 may be formed by coating a film with the conductive layer 13 by a deposition method. In the example of FIG. 3, the conductive layer 13 is deposited on a surface of the glass plate 12 facing the glass plate 11 so that the glass plate 12 is coated with the conductive layer 13. In the example of FIG. 4, the conductive layer 13 is deposited on a surface of the glass plate 11 facing the glass plate 12 so that the glass plate 11 is coated with the conductive layer 13.

Figure 5:
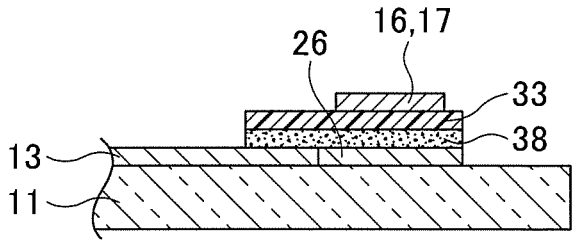
FIG. 5 is a cut-away side view of a windshield.
Figure 6:
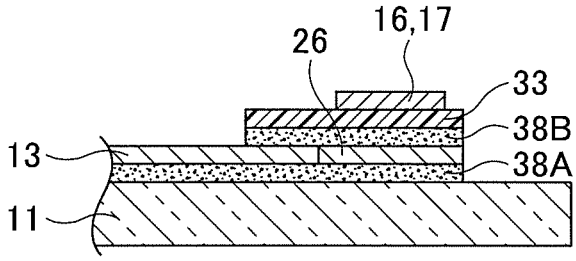
FIG. 6 is a cut-away side view of a windshield.

Also, as illustrated by FIGS. 5 and 6, the windshield of the present embodiment is not necessarily laminated glass. In this case, the size of a dielectric is not necessarily the same as the size of the glass plate 11. For example, a dielectric substrate having a size sufficient to form the electrodes 16 and 17 may be used. In FIGS. 5 and 6, the conductive layer 13 is disposed between the glass plate 11 and the dielectric substrate 33. In the example of FIG. 5, the conductive layer 13 is deposited on a surface of the glass plate 11 facing the dielectric substrate 33 so that the glass plate 11 is coated with the conductive layer 13. The conductive layer 13 and the dielectric substrate 33 are bonded together via an adhesive layer 38. In the example of FIG. 6, the conductive layer 13 is bonded via an adhesive layer 38A to a surface of the glass plate 11 facing the dielectric substrate 33. The conductive layer 13 and the dielectric substrate 33 are bonded together via an adhesive layer 38B. The dielectric substrate 33 is a resin substrate on which the electrodes 16 and 17 are provided. The dielectric substrate 33 may be a resin printed-circuit board (e.g., a glass epoxy board formed by attaching copper foil on an FR4 substrate) on which the electrodes 16 and 17 are printed.

Figure 7:
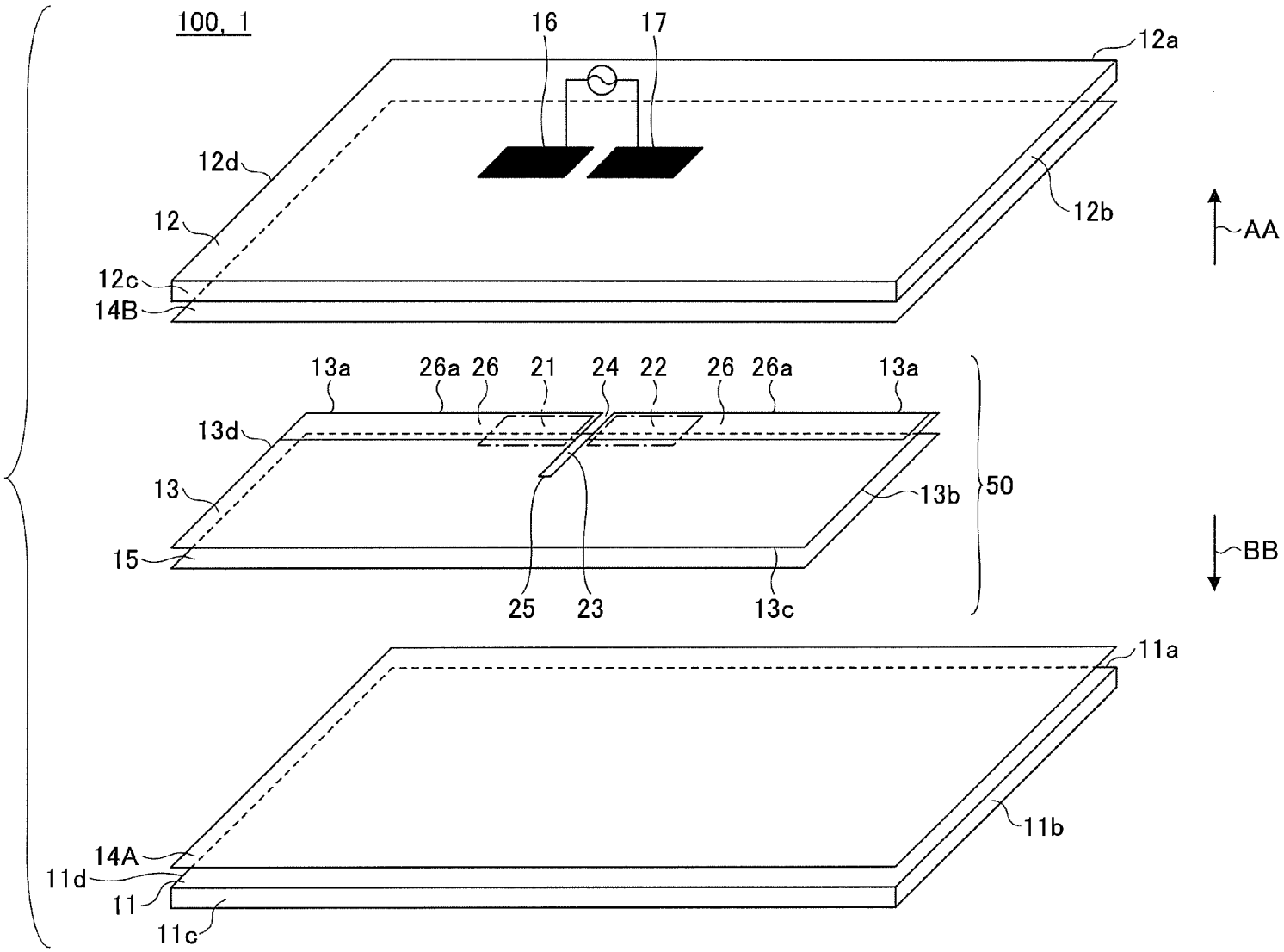
FIG. 7 is an exploded view of a windshield and an antenna.

FIG. 7 is an exploded view of the windshield 100 and the antenna 1 with the configuration of FIG. 2. In FIG. 7, for example, an arrow AA indicates a direction toward the inside of a vehicle, and an arrow BB indicates a direction toward the outside of a vehicle.

The windshield 100 is laminated glass formed by bonding the glass plate 11 that is a first glass plate disposed to face the outside of the vehicle and the glass plate 12 that is a second glass plate disposed to face the inside of the vehicle via the interlayers 14A and 14B. In FIG. 7, components of the windshield 100 are separated in the direction of a normal of a surface of the glass plate 11 (or the glass plate 12). FIG. 7 also illustrates as parts of the windshield 100, the electrothermal layer 50 including the conductive layer 13 and the bus bar 26 and the antenna 1.

The glass plates 11 and 12 are transparent plate-shaped dielectrics. One or both of the glass plates 11 and 12 may be translucent. In the windshield 100 of FIG. 7, the glass plate 11 and the glass plate 12 have the same size. Glass edges 11*a* through 11*d* outlining the glass plate 11 and glass edges 12*a* through 12*d* outlining the glass plate 12 have the same shape when seen from a direction (which is hereafter referred to as a "stacking direction") in which the glass plate 12, the conductive layer 13, and the glass plate 11 are stacked.

The interlayers 14A and 14B are disposed between the glass plate 11 and the glass plate 12. The glass plate 11 and the glass plate 12 are bonded via the interlayers 14A and 14B. The interlayers 14A and 14B are comprised of, for example, thermoplastic polyvinyl butyral. The relative dielectric constant ∈r of the interlayers 14A and 14B may be greater than or equal to 2.8 and less than or equal to 3.0 that is a typical relative dielectric constant of an interlayer of laminated glass.

The antenna 1 is a bipolar antenna that includes the glass plate 12 used as a dielectric, the electrothermal layer 50 including the bus bar 26 and the conductive layer 13 in which the slot 23 is formed, the electrodes 16 and 17 disposed to face the electrothermal layer 50 across the glass plate 12, and the slot 23. The interlayers 14A and 14B may also be used as dielectrics of the antenna 1.

The conductive layer 13 is, for example, a conductive film formed on a surface of a resin film 15 such as a polyethylene terephthalate film. Alternatively, the conductive layer 13 may be formed (film forming) by, for example, sputtering a conductive material such as silver onto a surface of the glass plate 11 or the glass plate 12.

The electrodes 16 and 17 are feeders disposed to face the electrothermal layer 50 across the glass plate 12 that is a dielectric. A dielectric is provided between the electrodes 16 and 17 and the electrothermal layer 50. Therefore, the electrode 16 is capacitively coupled via the glass plate 12 to a projection area 21 that is a projection of the electrode 16 on the electrothermal layer 50, and the electrode 17 is capacitively coupled via the glass plate 12 to a projection area 22 that is a projection of the electrode 17 on the electrothermal layer 50. The projection areas 21 and 22 are conductive parts included in at least one of the conductive layer 13 and the bus bar 26.

The electrodes 16 and 17 are disposed on the opposite side of the glass plate 12 from the conductive layer 13. The electrode 16 is exposed and disposed on a surface of the glass plate 12 facing the inside of the vehicle such that the projection area 21 formed by projecting the electrode 16 in the stacking direction is positioned inside of the bus bar edge 26*a* of the bus bar 26. The surface of the glass plate 12 facing the inside of the vehicle is opposite from a surface of the glass plate 12 facing the conductive layer 13. The electrode 17 is disposed in a similar manner.

The electrodes 16 and 17 are arranged in a direction that is orthogonal to the longitudinal direction of the slot 23 and is parallel to a surface of the glass plate 12. The positional relationship between the electrode 16 and the electrode 17 is not limited to this example. As another example, the electrodes 16 and 17 may be arranged such that the slot 23 is offset from a middle area between the electrodes 16 and 17 when seen from the stacking direction. A part or the whole of the electrodes 16 and 17 may overlap the slot 23 when seen from the stacking direction. Also, the electrodes 16 and 17 may be disposed at positions that are away from the layer edge 13*a* in an in-plane direction of the conductive layer 13 along the slot 23.

The configurations (shape, size, etc.) of the slot 23 and the electrodes 16 and 17 may be determined freely as long as the antenna 1 can achieve an antenna gain that is necessary to receive a radio wave in a frequency band that the antenna 1 is intended to receive. For example, when the antenna 1 is intended to receive a digital terrestrial television broadcasting frequency band of 470-710 MHz, the slot 23 and the electrodes 16 and 17 are formed to suit the reception of a radio wave in the digital terrestrial television broadcasting frequency band of 470-710 MHz.

The slot 23 and the electrodes 16 and 17 may be placed in any appropriate positions on the windshield that are suitable to receive a radio wave in a frequency band that the antenna 1 is intended to receive. For example, an antenna of the present embodiment is disposed near a vehicle flange to which the windshield is attached. Disposing the antenna near a roof-side edge of a vehicle flange is preferable to make it easier to achieve impedance matching and to improve radiation efficiency. Also, the antenna may be disposed at a position that is shifted from the center in the vehicle width direction to the right or the left, i.e., at a position closer to a pillar-side edge of the vehicle flange. Further, the antenna may be disposed near a chassis-side edge of the vehicle flange.

The longitudinal direction of the slot 23 matches, for example, a direction that is away from the outer edge of the electrothermal layer 50 and is orthogonal to an edge of the vehicle flange. However, the longitudinal direction of the slot 23 is not necessarily orthogonal to an edge of the vehicle flange (or at least one of the layer edge 13*a* of the conductive layer 13 and the bus bar edge 26*a* of the bus bar 26), and an angle between the longitudinal direction of the slot 23 and the edge of the vehicle flange may be greater than or equal to 5 degrees and less than 90 degrees.

The angle of mounting the windshield on a vehicle is preferably between 15 and 90 degrees and more preferably between 30 and 90 degrees with respect to a horizontal plane (ground surface) to make it easier to achieve impedance matching and to improve radiation efficiency.

Figure 8:
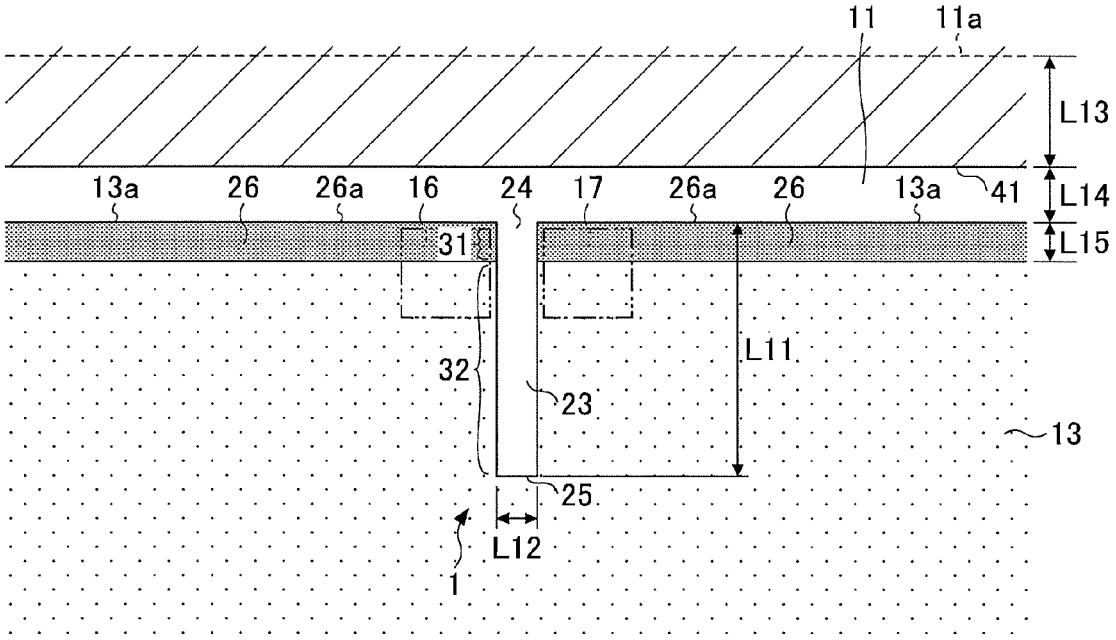
FIG. 8 is an enlarged plan view of a part of a windshield attached to a vehicle.

FIG. 8 is an enlarged plan view of a part of the windshield 100 of FIG. 1 attached to a vehicle. The windshield 100 is attached to a vehicle opening edge 41 such that the glass edge 11*a* of the first glass plate 11 overlaps the vehicle opening edge 41. The vehicle opening edge 41 is a vehicle body part to which the windshield 100 is attached, and is, for example, a flange of a window frame formed in a vehicle body.

To effectively increase the antenna gain of the antenna 1, the slot 23 is preferably configured to become orthogonal to a direction along the vehicle opening edge 41 when the windshield 100 is attached to the vehicle opening edge 41.

The antenna 1 is preferably disposed near the vehicle opening edge 41 on the roof side of the vehicle to improve the antenna gain. However, the antenna 1 may also be disposed near a vehicle opening edge (e.g., a pillar-side vehicle opening edge, a chassis-side vehicle opening edge, or the like) that is different from the vehicle opening edge 41.

In the example of FIG. 8, the slot 23 includes the bus bar slot 31 formed in the bus bar 26 and the conductive layer slot 32 formed in the conductive layer 13 that communicate with each other, and extends linearly in an in-plane direction of the conductive layer 13.

Let us assume that $\lambda_0$ indicates a wavelength in the air of a radio wave received by the antenna 1 at the center frequency of a predetermined frequency band, k indicates a glass wavelength shortening coefficient on a plane where the slot 23 is present, and $\lambda_g = k \cdot \lambda_0$. Here, for example, when a conductive layer is formed on a single glass plate, the glass wavelength shortening coefficient k is about 0.64; and when the antenna 1 is laminated glass formed by stacking two glass plates via an interlayer and a conductive layer is formed on a surface of one of the glass plates contacting the interlayer, the glass wavelength shortening coefficient k is about 0.5. In this case, a slot length L11 from the open end 24 of the slot 23 is preferably greater than or equal to $(1/10) \cdot \lambda_g$ and less than or equal to $(1/2) \cdot \lambda_g$, and more preferably greater than or equal to $(1/8) \cdot \lambda_g$ and less than or equal to $(1/4) \cdot \lambda_g$. In the example of FIG. 8, the slot length L11 from the open end 24 of the slot 23 represents the distance of the shortest route between the open end 24 and the end 25, and corresponds to the length of the slot 23 in the longitudinal direction. This configuration makes it possible to effectively increase the antenna gain.

For example, when the antenna 1 is intended to receive the digital terrestrial television broadcasting frequency band of 470-710 MHz, the slot length L11 from the open end 24 of the slot 23 is preferably greater than or equal to 25 mm and less than or equal to 130 mm, and more preferably greater than or equal to 30 mm and less than or equal to 65 mm. This configuration makes it possible to effectively increase the antenna gain.

Also, a slot width L12 of the slot 23 is preferably greater than or equal to 0.01 mm and less than or equal to 30 mm. This configuration makes it possible to effectively increase the antenna gain in the digital terrestrial television broadcasting frequency band of 470-710 MHz. In the example of FIG. 3, the slot width L12 is a width of the slot 23 in a direction that is orthogonal to the longitudinal direction of the slot 23.

For example, when the electrode 17 is used for a signal line and the electrode 16 is used for a ground line, the electrode 17 is conductively connected to the signal line connected to a signal processing apparatus (e.g., an amplifier) provided in a vehicle body, and the electrode 16 is conductively connected to the ground line connected to a ground of the vehicle body. The ground of the vehicle body is, for example, body grounding or a ground of the signal processing apparatus to which the signal line connected to the electrode 17 is connected. Alternatively, the electrode, 17 may be used for the ground line, and the electrode 16 may be used for the signal line.

A received radio wave that is represented by an electric current generated along the slot 23 of the antenna 1 is transmitted via a conductive part electrically connected to the electrodes 16 and 17 to the signal processing apparatus provided in the vehicle. As the conductive part, a feeder line such as an AV line or a coaxial cable is preferably used.

When a coaxial cable is used as a feeder line for supplying electricity via the electrodes 16 and 17 to the antenna 1, for example, the inner conductor of the coaxial cable may be electrically connected to the electrode 17, and the outer conductor of the coaxial cable may be connected to the electrode 16. Also, connectors for electrically connecting the electrodes 16 and 17 to conductive parts such as wires connected to the signal processing apparatus may be attached to the electrodes 16 and 17. Such connectors make it easier to connect the inner conductor of the coaxial cable to the electrode 17 and connect the outer conductor of the coaxial cable to the electrode 16. Further, protruding conductive parts may be attached to the electrodes 16 and 17. In this case, for example, the protruding conductive parts are brought into contact with or fit into feeding parts provided in a vehicle flange to which the windshield 100 is attached.

The shape of the electrodes 16 and 17 and the distance between the electrodes 16 and 17 may be determined taking into account the shape of the mounting surfaces of the conductive parts or the connectors described above and the distance between the mounting surfaces. For example, in terms of implementation, the electrodes 16 and 17 preferably have a quadrangular shape such as a square shape, an approximately-square shape, a rectangular shape, or an approximately-rectangular shape. Still, however, the electrodes 16 and 17 may have a circular shape, an approximately-circular shape, an oval shape, or an approximately-oval shape.

The electrodes 16 and 17 are formed, for example, by printing a pattern on the inner surface of the glass plate 12 with a paste such as a silver paste including a conductive metal, and baking the printed pattern. However, the electrodes 16 and 17 may also be formed by any other method. For example, the electrodes 16 and 17 may be formed by bonding strip-like or foil-like parts comprised of a conductive material such as copper to the inner surface of the glass plate 12 using, for example, an adhesive.

Also, to make the electrodes 16 and 17 invisible from the outside of the vehicle, a masking film may be formed on a surface of the glass plate 11 such that the masking film is disposed between the electrodes 16 and 17 and the glass plate 11. The masking film may be implemented by, for example, ceramic, which is a burned substance, such as a black ceramic film. In this case, the electrodes 16 and 17 and a part of the antenna 1 on the masking film are masked by the masking film and become invisible from the outer side of the windshield. Thus, this configuration improves the design of the windshield.

FIGS. 9 through 14 illustrate antennas according to embodiments different from the antenna 1. These embodiments can also improve the antenna gain.

Figure 9:
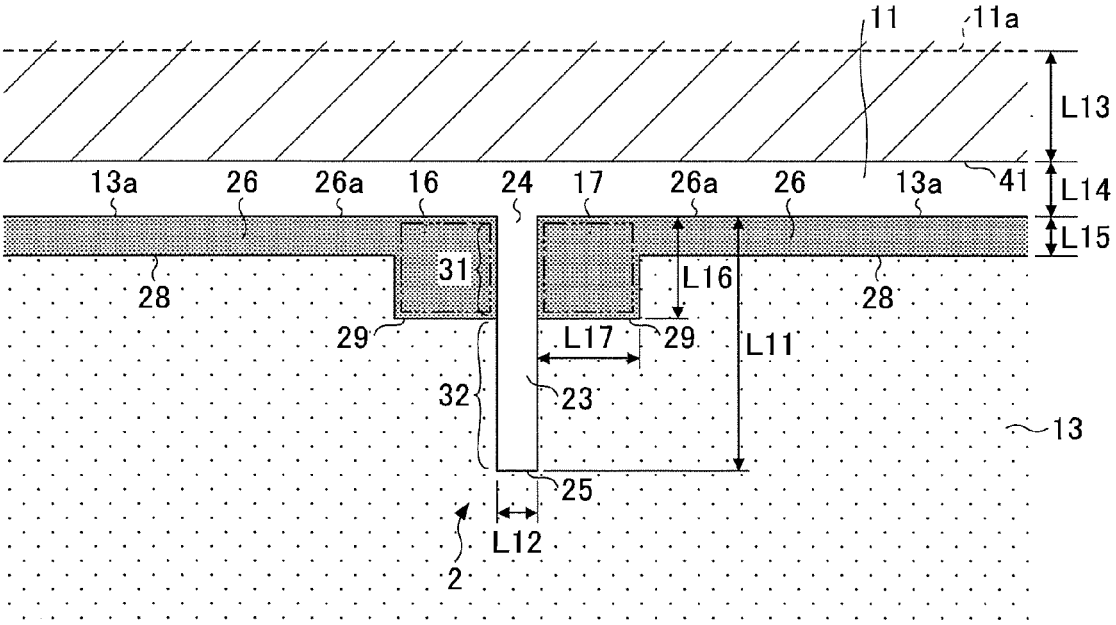
FIG. 9 is an enlarged plan view of a part of a windshield attached to a vehicle.

In the case of an antenna 2 of FIG. 9, the bus bar 26 includes a wide portion 29 and a narrow portion 28 that is narrower than the wide portion 29. The bus bar slot 31 of the slot 23 is formed in the wide portion 29 of the bus bar 26. With the configuration where at least a part of the slot 23 is formed in the wide portion 29, the area of a low resistance part in contact with the slot 23 increases compared with the case of FIG. 8. Accordingly, this configuration facilitates generation of an electric current along the slot 23, and improves the antenna gain of the antenna 2.

Figure 10:
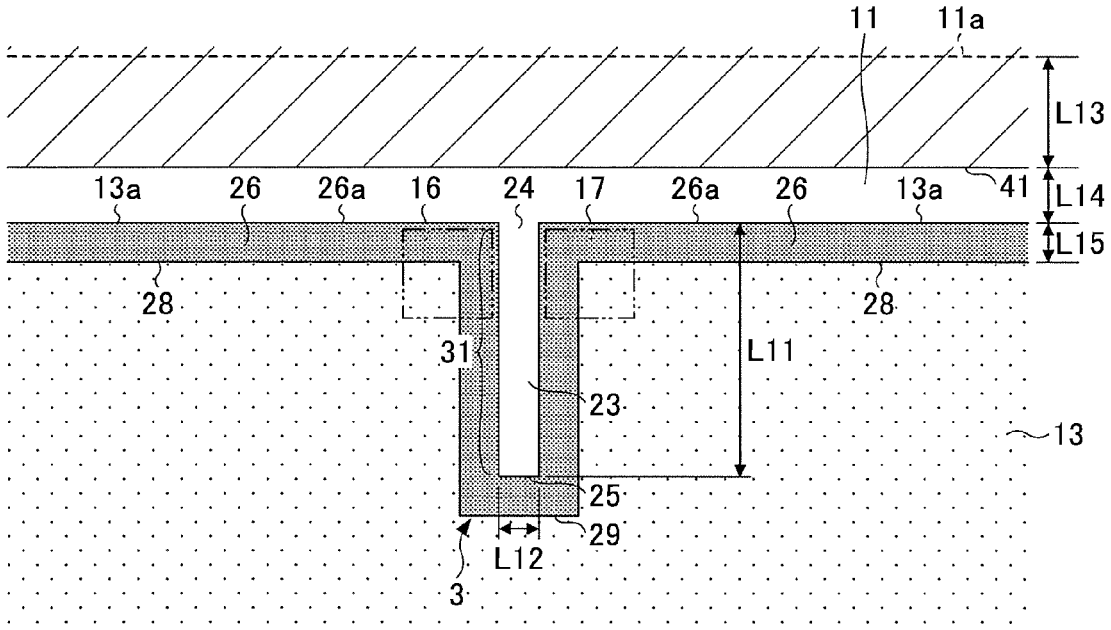
FIG. 10 is an enlarged plan view of a part of a windshield attached to a vehicle.

In the case of an antenna 3 of FIG. 10, the slot 23 is not formed in the conductive layer 13, and is formed only in a wide portion 29 of the bus bar 26. That is, the entire slot 23 is formed only in the bus bar 26. This configuration further increases the area of a low resistance part in contact with the slot 23, thereby facilitates generation of an electric current along the slot 23, and improves the antenna gain of the antenna 3. Also with this configuration, the bus bar 26 is not divided by the slot 23. Therefore, this configuration makes it possible to connect the bus bar 26 to a power source at a single connection point.

Figure 11:
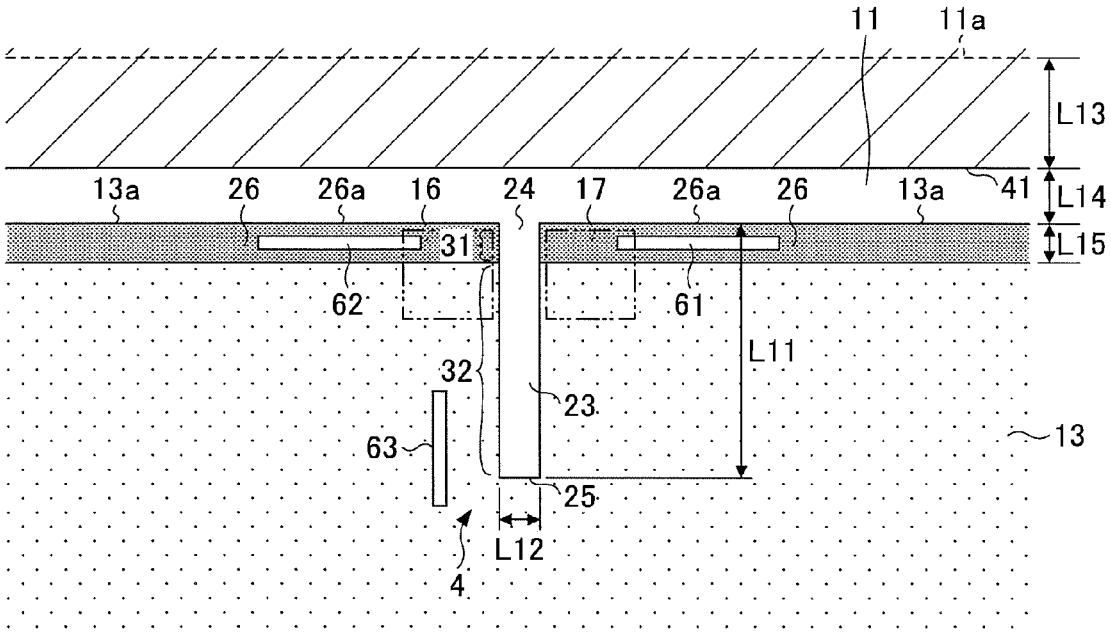
FIG. 11 is an enlarged plan view of a part of a windshield attached to a vehicle.

An antenna 4 of FIG. 11 includes independent slots 61, 62, and 63 that are disposed near the slot 23 but are not connected to the slot 23. The independent slots 61 and 62 are formed only in the bus bar 26, and the independent slot 63 is formed only in the conductive layer 13. The independent slots 61 and 62 are provided separately from the slot 23 and are not connected to the slot 23. The independent slots 61 and 62 are formed by removing linear areas of the bus bar 26 and are not open even at the outer edge of the electrothermal layer 50. In the example of FIG. 11, the independent slots 61 and 62 are disposed to extend in a direction orthogonal to the longitudinal direction of the slot 23. However, the independent slots 61 and 62 may be disposed to extend in a direction parallel to the longitudinal direction of the slot 23. The independent slot 63 is provided separately from the slot 23 and is not connected to the slot 23. The independent slot 63 is formed by removing a linear area of the conductive layer 13 and is not open even at the outer edge of the electrothermal layer 50. In the example of FIG. 11, the independent slot 63 is disposed to extend in a direction parallel to the longitudinal direction of the slot 23. However, the independent slot 63 may be disposed to extend in a direction orthogonal to the longitudinal direction of the slot 23. The independent slots enable the slot 23 to support a wider bandwidth.

Figure 12:
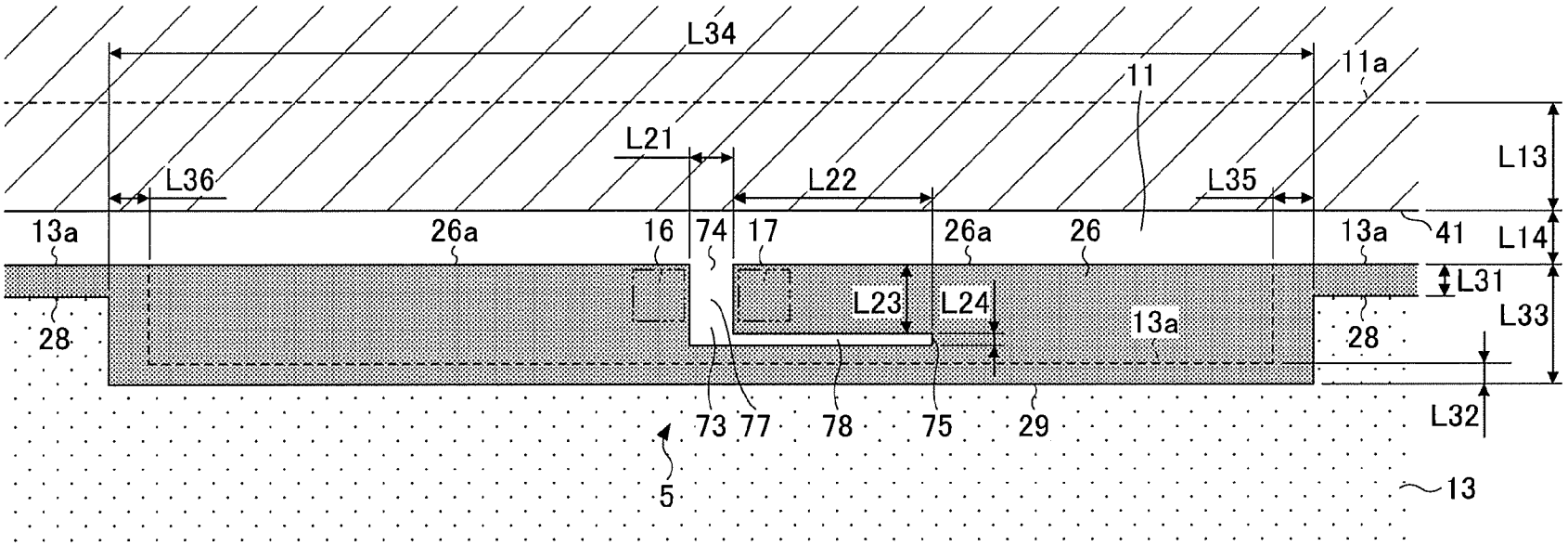
FIG. 12 is an enlarged plan view of a part of a windshield attached to a vehicle.

In the case of an antenna 5 of FIG. 12, the entirety of a slot 73 is formed only in the bus bar 26. The slot 73 includes a main slot 77 extending in a direction away from the outer edge of the electrothermal layer 50 and a parallel slot 78 extending in a direction parallel to the outer edge of the electrothermal layer 50, the main slot 77 and the parallel slot 78 forming an L-shape. One end of the slot 73 is an open end 74 that is open at the bus bar edge 26*a* of the bus bar 26, and another end of the slot 73 is an end 75 that is closed in the bus bar 26 and is not open at any edge. Forming the slot 73 in an L-shape makes it possible to reduce the slot length in an in-plane direction of the conductive layer 13 and thereby makes it possible to reduce the height of the antenna 5. This in turn makes it possible to improve the appearance of the windshield. Also with this configuration, because the bus bar 26 is not divided by the slot 73, it is possible to connect the bus bar 26 to a power source at a single connection point.

Also in the example of FIG. 12, the layer edge 13*a* of the conductive layer 13 is recessed in a direction away from the glass edge 11*a* with respect to the bus bar edge 26*a* of an area of the bus bar 26 where the slot 73 is formed. L32, L35, and L36 indicate widths of parts of the bus bar 26 that overlap the conductive layer 13.

Figure 13:
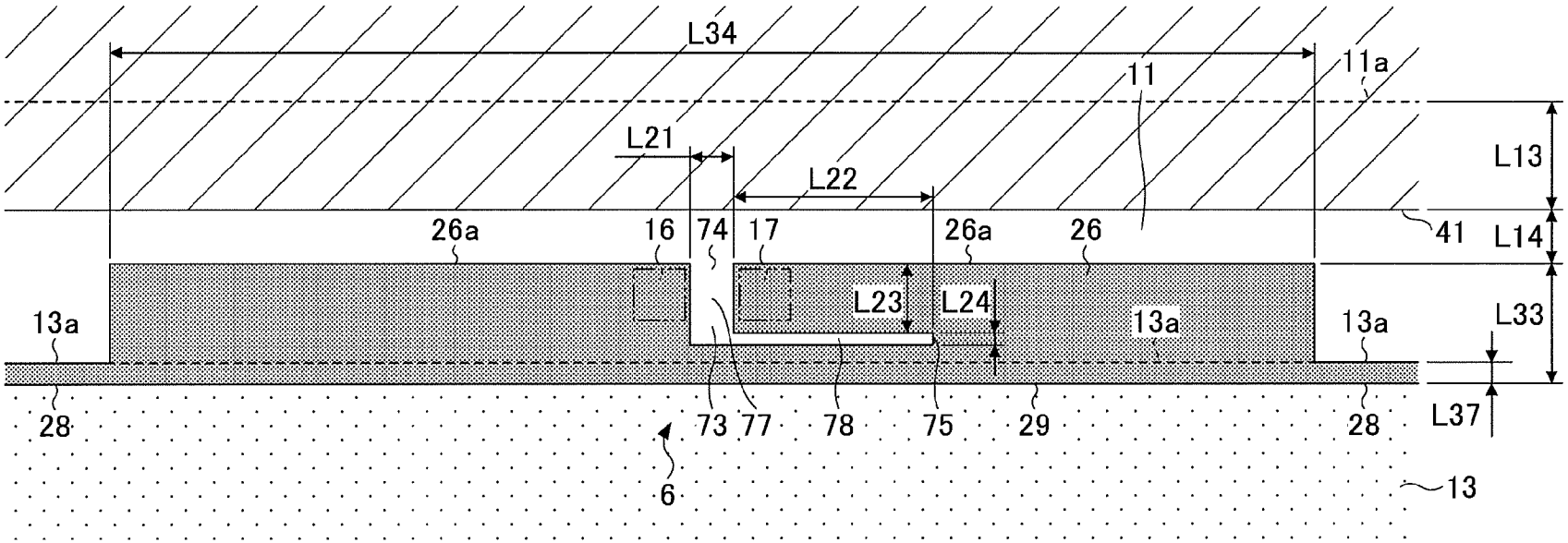
FIG. 13 is an enlarged plan view of a part of a windshield attached to a vehicle.

An antenna 6 of FIG. 13 has the same slot shape as the antenna 5 of FIG. 12, but has a configuration where the bus bar edge 26*a* of an area of the bus bar 26 in which the slot 73 is formed protrudes from the layer edge 13*a* of the conductive layer 13 toward the glass edge 11*a*. L37 indicates a width of a part of the bus bar 26 that overlaps the conductive layer 13.

Figure 14:
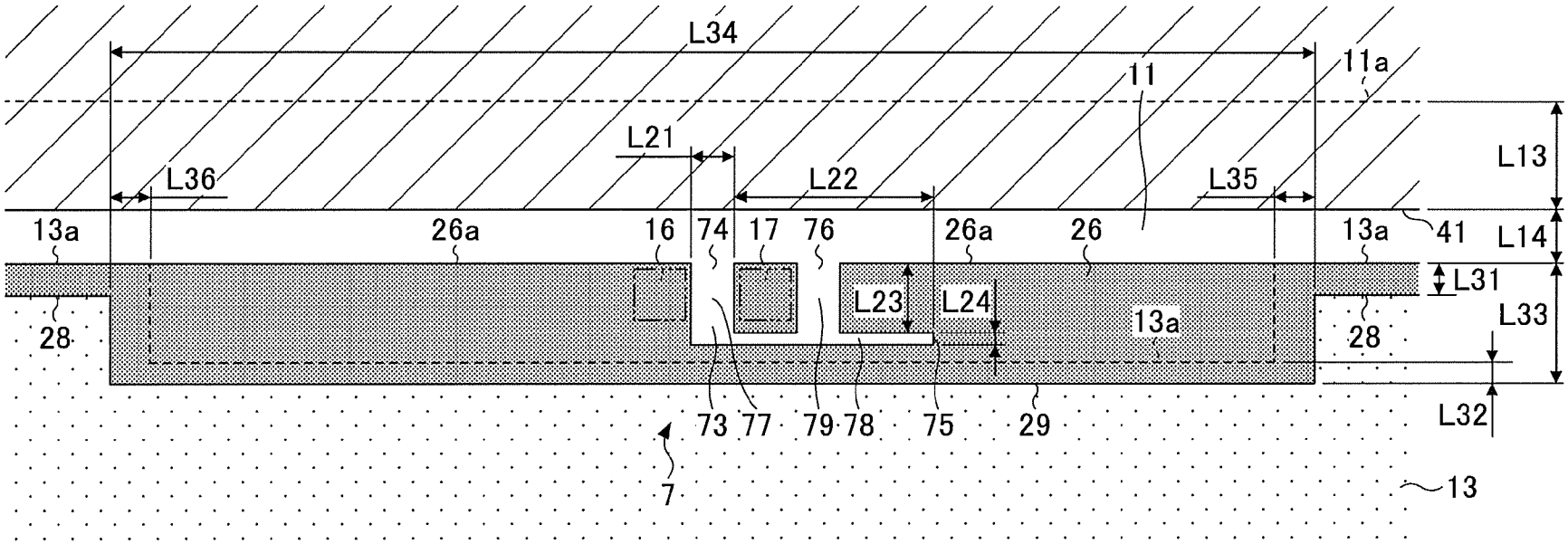
FIG. 14 is an enlarged plan view of a part of a windshield attached to a vehicle.

In the case of an antenna 7 of FIG. 14, different from FIG. 12, the slot 73 also includes a sub slot 79 connected to the parallel slot 78. The sub slot 79 includes an open end 76 that is open at the outer edge of the electrothermal layer 50. The slot 73 has an F-shape formed by the main slot 77, the parallel slot 78, and the sub slot 79. One end of the slot 73 is an open end 74 that is open at the bus bar edge 26*a* of the bus bar 26, and another end of the slot 73 is an end 75 that is closed in the bus bar 26 and is not open at any edge. The slot 73 includes the sub slot 79 that is open at the bus bar edge 26*a* and disposed in a slot path from the open end 74 to the end 75 such that the slot 73 forms an F-shape. Forming the slot 73 in an F-shape makes it possible to reduce the slot length in an in-plane direction of the conductive layer 13 and thereby makes it possible to reduce the height of the antenna 7. This in turn makes it possible to improve the appearance of the windshield. Also with this configuration, because the bus bar 26 is not divided by the slot 73, it is possible to connect the bus bar 26 to a power source at a single connection point.

In addition to the L-shaped slot and the F-shaped slot described above, a slot having, for example, a meandering shape may also be used to improve the appearance of the windshield.

Windshields and antennas according to the embodiments are described above. However, the present invention is not limited to the above described embodiments. Combinations of some or all of the embodiments and variation of the embodiments may be made without departing from the scope of the present invention.

For example, a sensor may be provided between the bus bars 26 and 27 to monitor a change in the voltage, current, or resistance between the bus bars 26 and 27, and the conductive layer 13 may be used as a conductor to detect a crack in the windshield 100.

Also, the bus bar 26 may be disposed along the layer edge 13*b* that becomes a side edge in the vehicle width direction when the windshield 100 is attached to the vehicle, and the bus bar 27 may be disposed along the layer edge 13*d* that becomes another side edge in the vehicle width direction when the windshield 100 is attached to the vehicle.

Also, the end 25 of the slot 23 may be formed in the bus bar 26, and a bottom part of the slot 23 on the side of the open end 24 may be formed in the conductive layer 13. Further, the end 25 of the slot 23 and a bottom part of the slot 23 on the side of the open end 24 may be formed in the conductive layer 13, and a middle part of the slot 23 between the end 25 and the bottom part may be formed in the bus bar 26.

EXAMPLES

Results of measuring the antenna gains of different types of antennas actually attached to a windshield are described below. For experimental purposes, a layer structure for the measurement of the antenna gain was prepared by forming the conductive layer 13 on the resin film 15 as illustrated in FIG. 7, and attaching the resin film 15 to the outer surface of the glass plate 11.

For the measurement of the antenna gain, a windshield including an antenna was attached to a window frame of a vehicle on a turntable such that the slot was inclined by about 25 degrees with respect to a horizontal plane. Connectors were attached to the electrodes 16 and 17 such that the inner conductor of a coaxial cable was connected to the electrode 17 and the outer conductor of the coaxial cable was connected to the electrode 16. The electrodes 16 and 17 were connected via the coaxial cable to a network analyzer. The turntable was rotated so that a radio wave would reach the windshield from all horizontal directions.

The center of the vehicle to which the windshield including an antenna was set at the center of the turntable, and the antenna gain was measured while rotating the vehicle 360 degrees. The antenna gain was measured for each rotational angle of 1 degree at 6 MHz intervals in the digital terrestrial television broadcasting frequency band of 470-710 MHz. The elevation angle between a radio wave emitting position and the antenna conductor was about 0 degrees (when the elevation angle of a plane parallel to the ground is 0 degrees, and the elevation angle of the zenith direction is 90 degrees).

EXAMPLE 1

Figure 15:
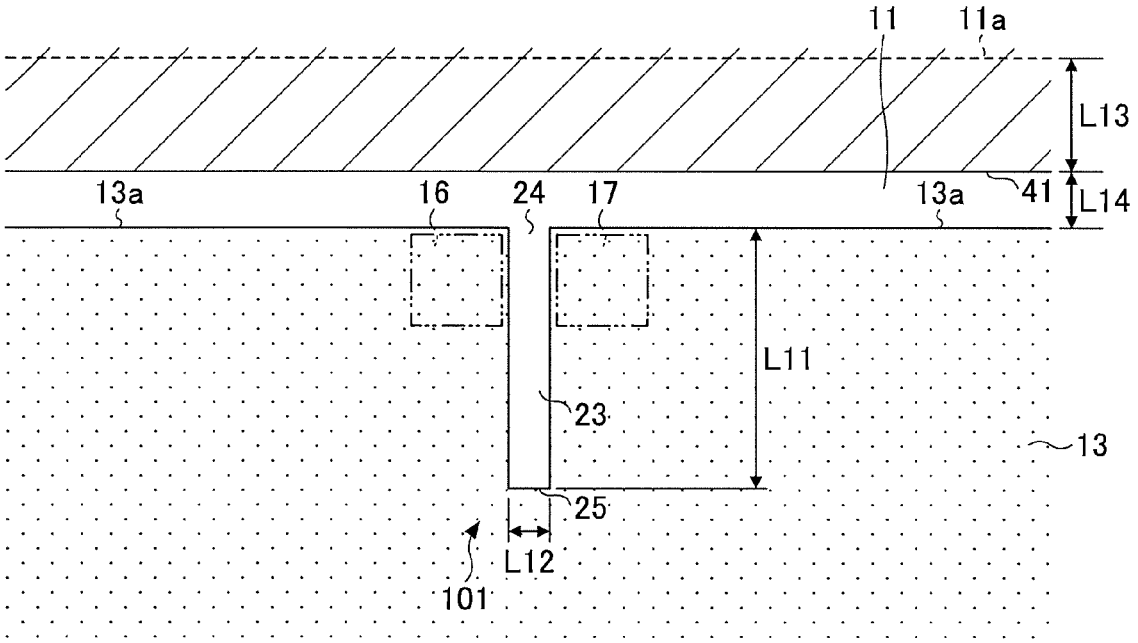
FIG. 15 is an enlarged plan view of a part of a windshield attached to a vehicle (comparative example)

FIG. 15 is a plan view of a windshield attached to a vehicle. An antenna 101 according to WO 2011/004877 is formed on the windshield of FIG. 15. For the measurement of the antenna gain, the windshield of FIG. 15 was prepared to have the same dimensions as those of the windshield of FIG. 1, and the windshield of FIG. 15 was disposed such that the slot 23 of FIG. 15 and the slot 23 of FIG. 1 were located at the same position. Different from the configuration of FIG. 8, the antenna 101 of FIG. 15 does not include the bus bar 26.

Figure 16:
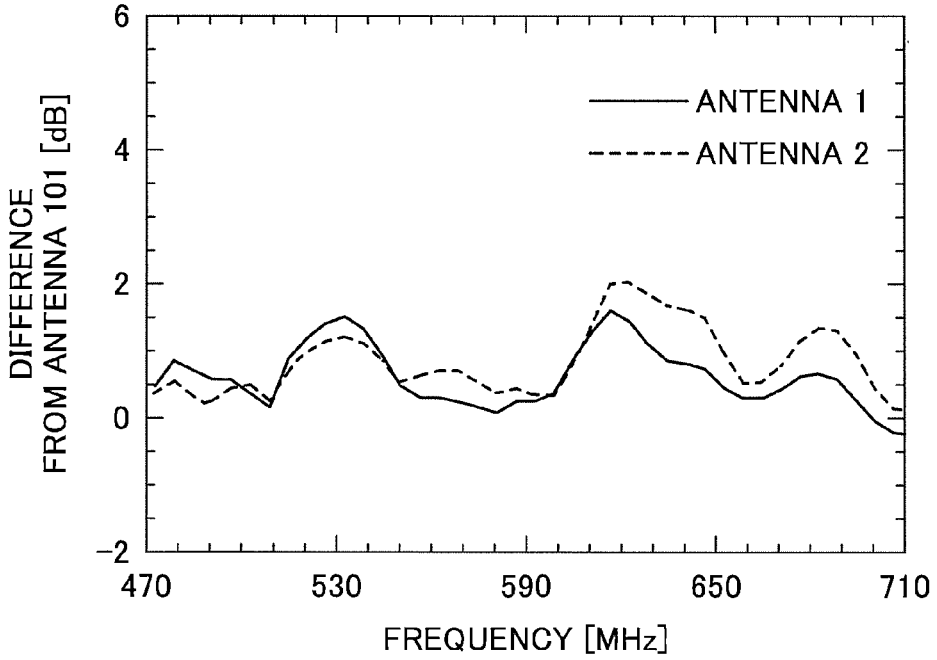
FIG. 16 is a graph illustrating antenna gains of antennas with different configurations.

FIG. 16 is a graph obtained based on antenna gains of the antennas 1, 2, and 101 measured by emitting a horizontally-polarized wave. FIG. 16 illustrates differences in antenna gain between the antennas 1 and 2 and the antenna 101 with the antenna gain of the antenna 101 indicated by 0 dB. The antenna 101 corresponds to FIG. 15. The antenna 1 corresponds to FIG. 8. The antenna 2 corresponds to FIG. 9.

Averages of antenna gain differences measured at 6 MHz intervals in the frequency range of 470-710 MHz of FIG. 16 were as follows (dB):

Antenna 1: 0.64 (horizontally polarized wave)

Antenna 2: 0.82 (horizontally polarized wave)

These results indicate that providing the bus bar 26 increases the antenna gain by 0.64 dB, and providing the wide portion 29 further increases the antenna gain by 0.18 dB. Thus, these results indicate improvement in the antenna gain.

For the measurement of the antenna gain in FIG. 16, dimensions of the antennas in FIGS. 8, 9, and 15 (and FIG. 1) were set as follows (mm):

L11: 52
L12: 10
L13: 21
L14: 10
L15: 8
L16 (each of two wide portions 29 facing across the slot 23): 20
L17 (each of two wide portions 29 facing across the slot 23): 20
L51: 1166
L52: 1104
L53: 1400
L54: 1400
L55: 1285
L56: 1402
L57: 802
L58: 693
L59: 650
L60: 757

Also, the shape of the electrodes 16 and 17 was a square of 20 mm×20 mm, the distance between the electrodes 16 and 17 was set at 10 mm, and the sheet resistance of the conductive layer 13 was set at 1.0Ω.

EXAMPLE 2

Figure 17:
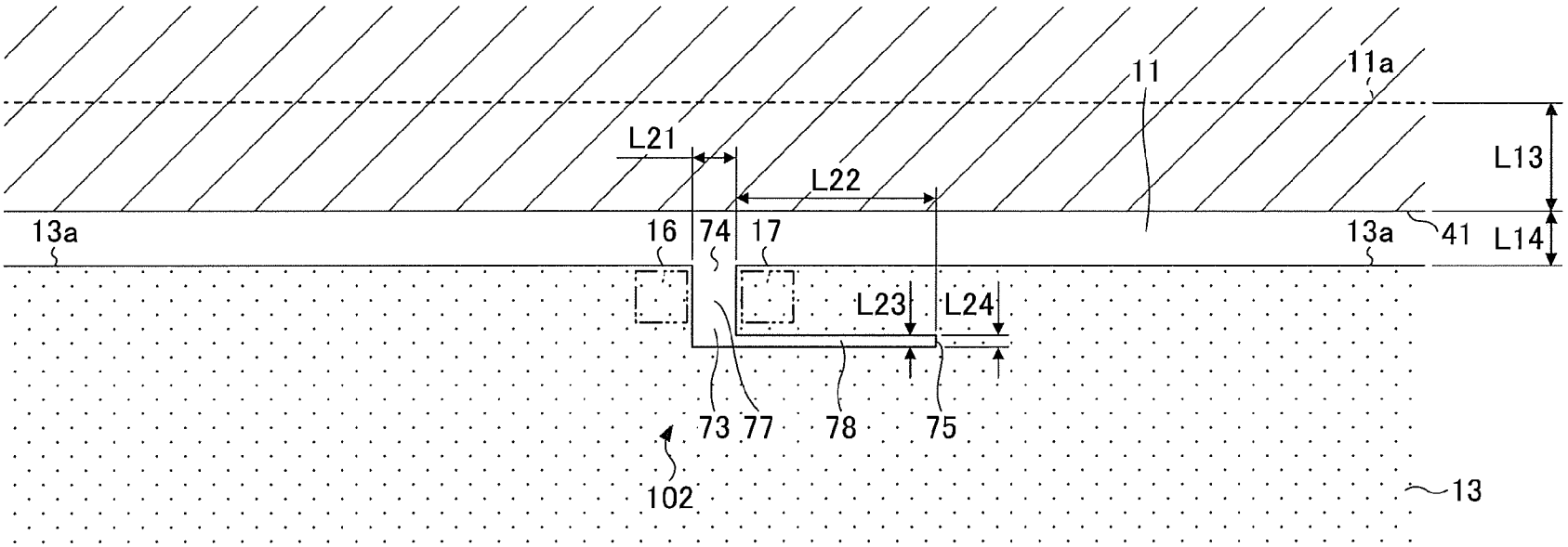
FIG. 17 is an enlarged plan view of a part of a windshield attached to a vehicle (comparative example)

FIG. 17 is a plan view of a windshield attached to a vehicle. An antenna 102 is formed on the windshield of FIG. 17. For the measurement of the antenna gain, the windshield of FIG. 17 was prepared to have the same dimensions as those of the windshield of FIG. 1, and the windshield of FIG. 17 was disposed such that an open end 74 of FIG. 17 and the open end 24 of FIG. 1 were located at the same position. Different from the configuration of FIG. 12, the antenna 102 of FIG. 17 does not include the bus bar 26.

Figure 18:
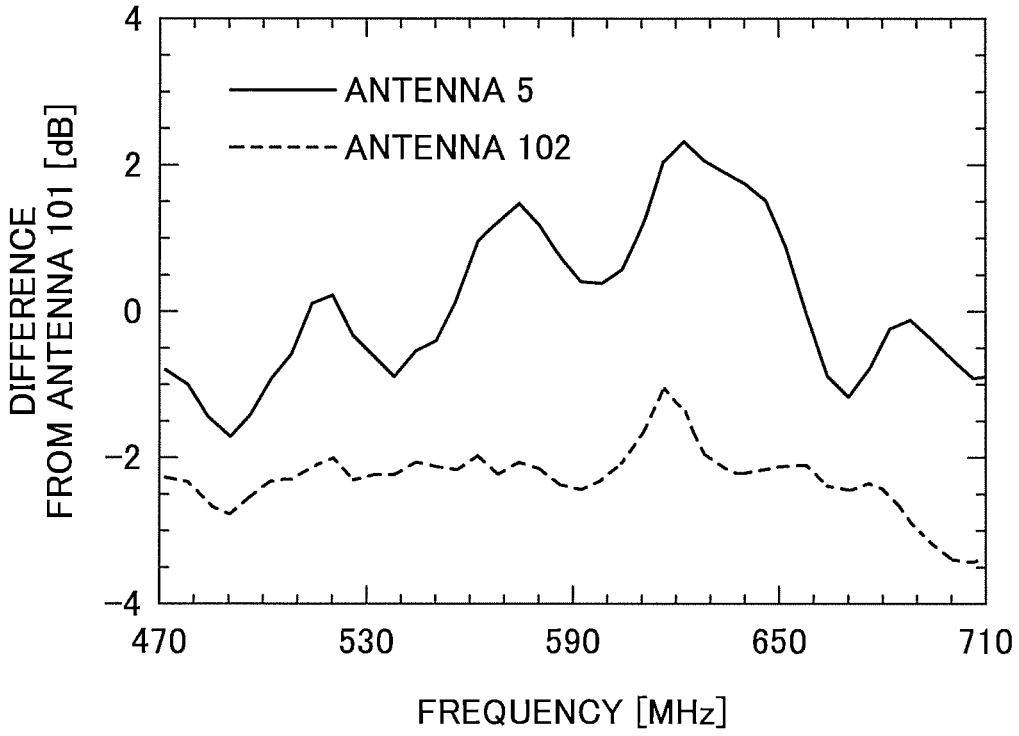
FIG. 18 is a graph illustrating antenna gains of antennas with different configurations.

FIG. 18 is a graph obtained based on antenna gains of the antennas 5, 101, and 102 measured by emitting a horizontally-polarized wave. FIG. 18 illustrates differences in antenna gain between the antennas 5 and 102 and the antenna 101 with the antenna gain of the antenna 101 indicated by 0 dB. The antenna 101 corresponds to FIG. 15. The antenna 5 corresponds to FIG. 12. The antenna 102 corresponds to FIG. 17.

Averages of antenna gain differences measured at 6 MHz intervals in the frequency range of 470-710 MHz of FIG. 18 were as follows (dB):

Antenna 5: 0.09 (horizontally polarized wave)

Antenna 102: −2.32 (horizontally polarized wave)

These results indicate that reducing the height of the antenna 101 of FIG. 15 as exemplified by the antenna 102 of FIG. 17 decreases the antenna gain, but the decreased antenna gain can be offset by providing the bus bar 26 as in the antenna 5 of FIG. 12.

For the measurement of the antenna gain in FIG. 18, dimensions of the antennas in FIGS. 12, 15, and 17 were set as follows (mm):

L21: 10
L22: 50
L23: 18
L24: 3
L31: 8
L32: 5
L33: 30
L34: 300
L35: 10
L36: 10

Dimensions illustrated in FIG. 1 are the same as those described in Example 1. Also, the distance between the electrodes 16 and 17 was set at 10 mm, and the sheet resistance of the conductive layer 13 was set at 1.0Ω. Also, the shape of the electrodes 16 and 17 in FIGS. 12 and 17 was a square of 14 mm×14 mm, and the shape of the electrodes 16 and 17 in FIG. 15 was a square of 20 mm×20 mm.

INDUSTRIAL APPLICABILITY

The present invention is suitably applicable for use as an antenna for automobile, designed to receive the digital terrestrial television broadcasting, the analog television broadcasting in UHF band, the digital television broadcasting in the United States of America, the digital television broadcasting in the European Union regions, or the digital television broadcasting in the People's Republic of China. Other applications include the FM broadcasting band (76 MHz to 90 MHz) in Japan, FM broadcasting band (88 MHz to 108 MHz) in the United States of America, the television VHF band (90 MHz to 108 MHz, 170 MHz to 222 MHz), and a keyless entry system for automobile (300 MHz to 450 MHz).

Additional applications include the 800 MHz band (810 MHz to 960 MHz) for car phone, the 1.5 GHz band (1.429 GHz to 1.501 GHz) for car phone, the GPS (Global Positioning System), the GPS signals of satellite (1575.42 MHz), and the VICS (registered trademark) (Vehicle Information and Communication System: 2.5 GHz).

Further applications include the ETC (Electronic Toll Collection System) communication (non-stop automatic toll collection system, transmission frequency of roadside radio device: 5.795 GHz or 5.805 GHz, reception frequency of roadside radio device: 5.835 GHz or 5.845 GHz), the DSRC (Dedicated Short Range Communication, 915 MHz band, 5.8 GHz band, 60 GHz band), and the microwave (1 GHz to 30 GHz), the millimeter wave (30 GHz to 300 GHz), and the SDARS (Satellite Digital Audio Radio Service, 2.34 GHz, 2.6 GHz) communications.

An aspect of this disclosure makes it possible to provide an antenna having a high antenna gain and a windshield including the antenna.

What is claimed is:

1. A windshield, comprising:

a glass plate;

a dielectric;

an electrothermal layer that is disposed between the glass plate and the dielectric, and includes a conductive layer and strip electrodes having a resistance lower than a resistance of the conductive layer; and an antenna including a pair of electrodes disposed to face the electrothermal layer across the dielectric, and a slot at least a part of which is formed in one of the strip electrodes such that the slot is disposed between the pair of electrodes in plan view, wherein the strip electrodes are disposed along at least two opposing outer edges of the conductive layer and are DC-coupled to the conductive layer such that the conductive layer is energized via the strip electrodes; and wherein one end of the slot is an open end that is open at an outer edge of the electrothermal layer.

2. The windshield as claimed in claim 1, wherein an entirety of the slot is formed in the one of the strip electrodes.

3. The windshield as claimed in claim 1, wherein the slot includes a strip electrode slot at least a part of which is formed in the one of the strip electrodes, and a conductive layer slot at least a part of which is formed in the conductive layer; and the strip electrode slot and the conductive layer slot communicate with each other.

4. The windshield as claimed in claim 1, wherein the slot includes a main slot extending in a direction away from the outer edge of the electrothermal layer and a parallel slot extending in a direction parallel to the outer edge of the electrothermal layer, the main slot and the parallel slot forming an L-shape.

5. The windshield as claimed in claim 4, wherein the slot further includes a sub slot that includes an open end at the outer edge of the electrothermal layer and is connected to the parallel slot; and an F-shape is formed by the main slot, the parallel slot, and the sub slot.

6. The windshield as claimed in claim 1, wherein when $\lambda_0$ indicates a wavelength in air of a radio wave received by the antenna at a center frequency of a predetermined frequency band, k indicates a glass wavelength shortening coefficient on a plane where the slot is present, and $\lambda_g = k \cdot \lambda_0$, a slot length from the open end of the slot is greater than or equal to $(1/10) \cdot \lambda_g$ and less than or equal to $(1/2) \cdot \lambda_g$.

7. The windshield as claimed in claim 1, wherein a slot length from the open end of the slot is greater than or equal to 25 mm and less than or equal to 130 mm.

8. The windshield as claimed in claim 1, wherein a slot width of the slot is greater than or equal to 0.01 mm and less than or equal to 30 mm.

9. The windshield as claimed in claim 1, wherein the antenna includes an independent slot that is disposed near the slot but is not connected to the slot.

10. The windshield as claimed in claim 1, wherein the one of the strip electrodes includes a wide portion and a narrow portion; and the slot is formed in the wide portion.

11. The windshield as claimed in claim 1, wherein the glass plate is a first glass plate and the dielectric is a second glass plate; and the windshield is formed as laminated glass by bonding the first glass plate and the second glass plate via an interlayer.

12. The windshield as claimed in claim 11, wherein the conductive layer is formed on a surface of one of the first glass plate and the second glass plate.

13. The windshield as claimed in claim 11, wherein the conductive layer is formed on a resin film and is disposed between the first glass plate and the second glass plate.

14. An antenna, comprising:

a dielectric;

an electrothermal layer including a conductive layer, and strip electrodes that are disposed along at least two opposing outer edges of the conductive layer and have a resistance lower than a resistance of the conductive layer;

a pair of electrodes disposed to face the electrothermal layer across the dielectric; and a slot at least a part of which is formed in one of the strip electrodes such that the slot is disposed between the pair of electrodes in plan view, wherein one end of the slot is an open end that is open at an outer edge of the electrothermal layer.

* * * * *